US010646839B2

(12) United States Patent
Dörr et al.

(10) Patent No.: US 10,646,839 B2
(45) Date of Patent: May 12, 2020

(54) MIXER COMPRISING CLEANING NOZZLE

(71) Applicant: Maschinenfabrik Gustav Eirich GmbH & Co. KG, Hardheim (DE)

(72) Inventors: Martin Dörr, Walldürn (DE); Clemens Schmitt, Walldürn-Altheim (DE)

(73) Assignee: Maschinenfabrik Gustav Eirich GmbH & Co. KG, Hardheim (DE)

( * ) Notice: Subject to any disclaimer, the term of this patent is extended or adjusted under 35 U.S.C. 154(b) by 0 days.

(21) Appl. No.: 16/484,221

(22) PCT Filed: Mar. 2, 2018

(86) PCT No.: PCT/EP2018/055182
§ 371 (c)(1),
(2) Date: Aug. 7, 2019

(87) PCT Pub. No.: WO2018/162348
PCT Pub. Date: Sep. 13, 2018

(65) Prior Publication Data

US 2020/0023325 A1 Jan. 23, 2020

(30) Foreign Application Priority Data

Mar. 8, 2017 (DE) ..... 10 2017 104 842

(51) Int. Cl.
*B01F 15/00* (2006.01)
*B01F 9/10* (2006.01)
(Continued)

(52) U.S. Cl.
CPC ..... *B01F 15/00032* (2013.01); *B01F 9/10* (2013.01); *B01F 15/00785* (2013.01);
(Continued)

(58) Field of Classification Search
CPC ..... B01F 15/0266; B01F 2215/0047; B03B 9/063; B60P 1/4421; B60P 1/5428
See application file for complete search history.

(56) References Cited

U.S. PATENT DOCUMENTS 1,765,544 A * 6/1930 Schuster ..... B01F 5/16 366/6
1,825,614 A * 9/1931 Eggert ..... B01F 15/00785 366/40
(Continued)

FOREIGN PATENT DOCUMENTS

DE 29 03 951 A1 8/1980
DE 199 04 994 A1 8/2000
(Continued)

OTHER PUBLICATIONS

International Preliminary Report on Patentability dated Jun. 21, 2019 for PCT/EP2018/055182.
(Continued)

*Primary Examiner* — Tony G Soohoo
(74) *Attorney, Agent, or Firm* — Faegre Drinker Biddle & Reath LLP

(57) ABSTRACT

A mixer includes a mixing container having an outlet opening; a closure cover, which can be moved back and forth between a closed position, in which the closure cover closes the outlet opening, and an open position, in which the closure cover uncovers the outlet opening so that mixture can be removed from the mixing container via the outlet opening; at least one cleaning nozzle to clean the closure opening and/or a mixture outflow region arranged outside the mixing container; and a liquid feed to feed cleaning fluid to the at least one cleaning nozzle. To provide a mixer and a method for enabling cost-effective, efficient, simple and operationally reliable cleaning of the mixture outflow region
(Continued)

and of the closure opening, at least one cleaning nozzle is fastened to the closure cover such that it is moved together with the closure cover.

6 Claims, 4 Drawing Sheets

(51) Int. Cl.
*B01F 15/02* (2006.01)
*B08B 9/093* (2006.01)

(52) U.S. Cl.
CPC ..... *B01F 15/0267* (2013.01); *B08B 9/093* (2013.01); *B01F 2215/0047* (2013.01)

(56) References Cited

U.S. PATENT DOCUMENTS 2,263,099 A * 11/1941 Olsen ..... B65G 69/188 366/164.1
2,537,585 A * 1/1951 Hilkemeier ..... B28C 7/128 366/40
3,199,844 A * 8/1965 Moore ..... B24C 7/0053 366/106
3,330,540 A * 7/1967 Kalich ..... B01F 15/00785 366/1
6,079,911 A * 6/2000 Wangermann ..... A01M 7/0092 406/122
6,464,386 B1 * 10/2002 Oota ..... B01F 3/1228 366/167.1
6,669,360 B1 12/2003 Adelmann et al.
6,860,313 B2 * 3/2005 Greissing ..... B01F 3/1228 164/412
8,839,810 B1 9/2014 Ellis et al.
2005/0180256 A1 8/2005 Kreutzer
2006/0240160 A1 * 10/2006 Peitzmeier ..... A21C 1/02 426/504
2012/0298210 A1 * 11/2012 Pham ..... B08B 9/093 137/15.04
2016/0296898 A1 * 10/2016 Degel ..... B08B 9/0813
2017/0036182 A1 * 2/2017 Westlind ..... B01F 13/0032
2017/0136508 A1 * 5/2017 James ..... B08B 9/0933
2017/0172348 A1 * 6/2017 Vu ..... B01F 7/1615
2018/0222451 A1 * 8/2018 McNeilus ..... B08B 9/00

FOREIGN PATENT DOCUMENTS

DE 20 2013 100812 U1 6/2014
JP 2003-094423 A 4/2003
WO WO-03/099472 A1 12/2003

OTHER PUBLICATIONS

German Search Report dated Dec. 8, 2017 for DE 10 2017 104 842.1.
Korean Office Action dated Feb. 3, 2020 issued in Korean patent application No. 10-2019-7029500.

* cited by examiner

MIXER COMPRISING CLEANING NOZZLE

CROSS REFERENCE TO RELATED APPLICATIONS

This application is a National Stage of International Application No. PCT/EP2018/055182 filed Mar. 2, 2018, which claims benefit of German Patent Application No. 10 2017 104 842.1 filed Mar. 8, 2017, both of which are herein incorporated by reference in their entirety.

The present invention relates to a mixer comprising a mixing container having an outlet opening and a closure cover which can be moved back and forth between a closed position in which the closure cover closes the outlet opening and an open position in which the closure cover uncovers the outlet opening so that mixture can be removed from the mixing container via the outlet opening.

The mixer has at least one cleaning nozzle for cleaning the outlet opening and/or a mixture outflow region arranged outside of the mixing container, and a liquid feed to feed cleaning fluid to the at least one cleaning nozzle.

In addition, the present invention relates to a method for cleaning an outlet region and/or a mixture outflow region of a mixer with an outlet opening and a closure cover which can be moved relative to the outlet opening.

Such a mixer with outlet opening is for example used to prepare concrete and is known from DE 2903951 C3. The preparation of fresh concrete for the manufacture of concrete products has the aim of producing, from the raw materials used, for example sand, gravel, cement and water, a homogeneous mixture with a desired/preselectable consistency and finally to make the prepared fresh concrete available for the further manufacture of the building component.

The use of water in the mixture gives rise to special requirements in terms of the tight sealing of the outlet opening, since when the mixing container is sealed the added liquid should not be able to overflow in an uncontrolled manner from the seal region into the mixture outflow region, since otherwise a change in the consistency of the mixture occurs due to interference with the liquid content in the mixture.

At the same time, the use of hardening substances such as cement leads to encrustations on the closure cover, the outlet opening as well as in the mixture outflow region which harden over time and cannot be washed off, which can lead to increasing problems in terms of the tightness of the seal and the emptying of the machine.

If concretes with a particularly low air pore content are to be produced, then this can be done with the aid of vacuum processing. However, in order to carry out this process it is necessary that the mixing container can in addition be sealed in a vacuum-tight manner. In order to be able to ensure vacuum tightness in continuous operation, a particularly good cleaning of the mixer closure, in particular the seal surrounding the closure cover and the outflow region, is necessary.

The corresponding mixing container has an outlet opening into which the closure cover can be moved in order to seal the mixing container in a dust-liquid- and if necessary vacuum-tight manner. The cover is thereby generally connected with the machine frame of the mixer so as to swivel around a swivel axis. Particularly preferably, the swivelling movement takes place in a substantially circular manner around a horizontally or substantially horizontally arranged swivel axis.

As a rule, the outlet opening is arranged on the underside of the mixing container, so that on opening the closure cover the mixture flows directly out of the outlet opening, via the closure cover, into the mixture outflow region.

A representation of such a mixer of the prior art is shown schematically in FIG. 1. The known mixer 1 has a mixing container 2 with an outlet opening 3 in which a closure cover 4 is arranged. The closure cover 4 has a swivel arm 5 with which it can be rotated around a swivel axis 6 and thus moved out of the outlet opening 3 and back into this. In the illustrated embodiment, the mixing container 2 is rotatable around the vertically arranged axis of rotation 7. Corresponding bearings 8 are provided for this purpose. Alternatively, the axis of rotation 7 can also be tilted in relation to the vertical.

A mixture outflow region 9 is illustrated below the mixing container 2.

Once the mixture contained in the mixing container 2 has been correspondingly prepared, the mixture can be removed in that the closure cover 4 is swivelled out of the outlet opening 3, around the swivel axis 6, with the aid of the swivel arm 5. The mixture contained in the mixing container 2 will then fall out of the outlet opening 3 automatically under the force of gravity or, assisted by the rotary movement of the mixing container, flow out of the outlet opening and thereby pass through the mixture outflow region. It is thereby unavoidable that the walls of the mixture outflow region as well as the closure cover including its edge surfaces become soiled by the mixture. This can lead to an accumulation of mixture residues which, on the one hand, prevent the closure cover 4 from being guided into the outlet opening 3 in a dust-liquid- or vacuum-tight manner. In addition, the caked-on deposits on the walls of the mixture outflow region reduce the cross sectional area available for the removal of the mixture or prevent the following mixture from flowing out.

It is therefore already usual to arrange cleaning nozzles 10 in the mixture outflow region 9 which can be supplied with cleaning fluid via a liquid feed 11 in order to clean the interior of the mixture outflow region, as well as the swivel arm and the closure cover, in the closed, open or partially open state, with cleaning fluid.

However, the arrangement of the cleaning nozzles is very complicated, given that each cleaning nozzle needs to have a corresponding feed channel for feeding cleaning fluid. In addition, the spray jet patterns of the individual cleaning nozzles always only cover a small region of the mixture outflow region, so that a correspondingly large number of cleaning nozzles need to be provided over the height and circumference of the mixture outflow region in order to clean the entire mixture outflow region 9, the swivel arm 5 and the closure cover 4 as completely as possible. However, since the mixture also flows over the cleaning nozzles and adheres thereto, soiling of the cleaning nozzles can occur and consequently malfunctions, so that the orifices of the cleaning nozzles themselves need to be cleaned regularly.

The objective of the present invention is therefore to provide a mixer and a method with which an economical, effective and simple as well as operationally reliable cleaning of the mixture outflow region and the seal orifice can take place.

According to the invention this objective is achieved in that the at least one cleaning nozzle is fastened to the closure cover, so that this can be moved together with the closure cover. Because the closure cover can be swivelled, this automatically leads to a swivelability of the corresponding cleaning nozzle, so that a comparatively large region of the mixture outflow region can be cleaned with a single cleaning nozzle.

In a preferred embodiment, the closure cover has a swivel arm which is mounted rotatably around a swivel axis. The cleaning nozzle can thereby be fastened to the swivel arm. The important thing is that the movement of the closure cover or of its swivel arm causes a movement of the cleaning nozzle. If the swivel axis is oriented horizontally, then a back-and-forth movement of the closure cover causes a movement of the cleaning nozzle on a circular path.

Particularly preferably, the cleaning nozzle is arranged on the end of the swivel arm opposite the swivel axis.

In a preferred embodiment, the liquid feed thereby runs through the swivel axis around which the closure cover can be swivelled.

In this case the liquid feed to the nozzles on the swivel arm can be effected in rigid form, for example by means of a pipe connection. Alternatively, the liquid feed can be arranged in a fixed location in the machine frame, so that a flexible connecting line to the nozzles or the swivel arm, for example by means of hoses, is necessary.

In a further preferred embodiment, a plurality of cleaning nozzles is provided which are fastened to the closure cover, wherein the cleaning nozzles are preferably configured such that in operation they produce a widening spray jet pattern.

It is thereby particularly preferable if the plurality of cleaning nozzles together create a partially annular or annular spray jet pattern. For example, the individual cleaning nozzles can be arranged such that they are arranged at the same distance from a central point. In other words, the cleaning nozzles can be arranged on an imaginary ring, so that in operation they produce an annular or partially annular spray jet around the central point.

The spray nozzles are thereby preferably oriented at one or more angles in relation to the central axis of the closure cover such that, taking into consideration the spray jet angle, when swivelling the cleaning nozzles both the outlet opening and also the mixture outflow region are covered as completely as possible, preferably over their entire surface and over the entire height as far as the corners of the mixture outflow region, by at least one spray jet.

The nozzles are also arranged beneath the closure cover, i.e. on the side facing away from the outlet opening, such that at no point during the emptying of the mixture are they flowed over by the mixture nor do they come into contact with mixture during the emptying.

By moving the closure cover relative to the outlet opening, virtually the entire mixture outflow region can thus be cleaned with the aid of the cleaning nozzles.

In a preferred embodiment, the mixer has a rotatable mixing container. In this case, the appropriate arrangement of one or more nozzles also allows the inner side of the outlet opening to be cleaned with the mixture outflow region closed or almost closed. Since the outlet opening is rigidly connected with the rotating container, by spraying a fixed point or a limited surface area in the region of the outlet opening, in combination with the rotary movement of the mixing container a virtually complete cleaning of the outlet opening over its entire circumference is achieved.

In a further particularly preferred embodiment, at least one cleaning nozzle is oriented in the direction of the swivel arm and/or the swivel shaft in order to remove effectively any mixture residues present there.

As regards the method for cleaning an outlet region and/or a mixture outflow region of a mixer with an outlet opening and a closure cover which is moveable relative to the outlet opening, the aforementioned objective is achieved through the steps:

A) arranging at least one cleaning nozzle on the closure cover or swivel arm,

B) feeding cleaning fluid to the cleaning nozzle and

C) moving the closure cover relative to the outlet opening.

Further advantages, features and possible applications of the present invention are made clear with reference to the following description of preferred embodiments as well as the associated figures, wherein:

FIG. 1 shows a schematic representation of a mixer of the prior art, which has already been described in detail above.

Figure 1:
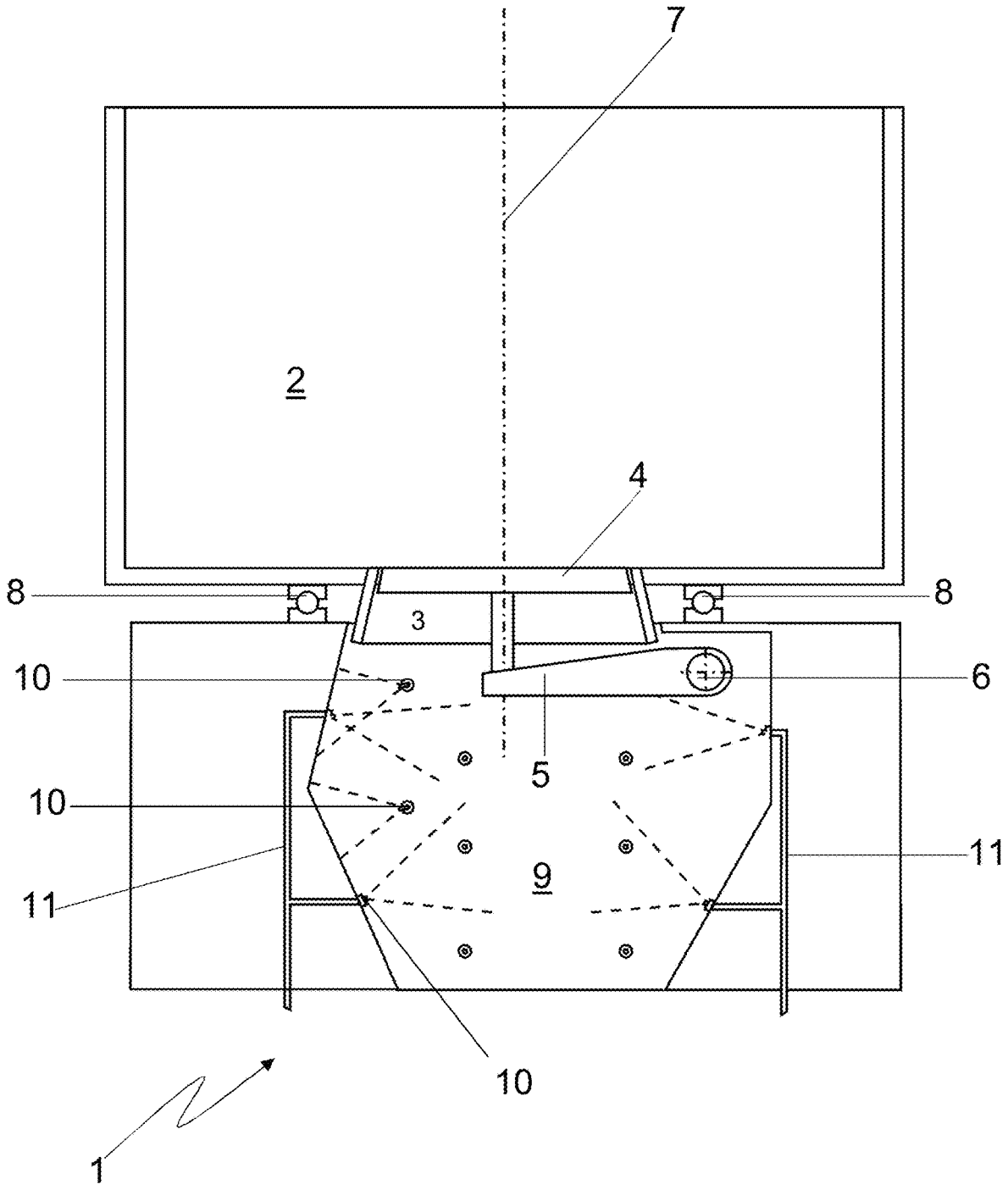
FIG. 1 shows a schematic representation of a mixer of the prior art.
Figure 2:
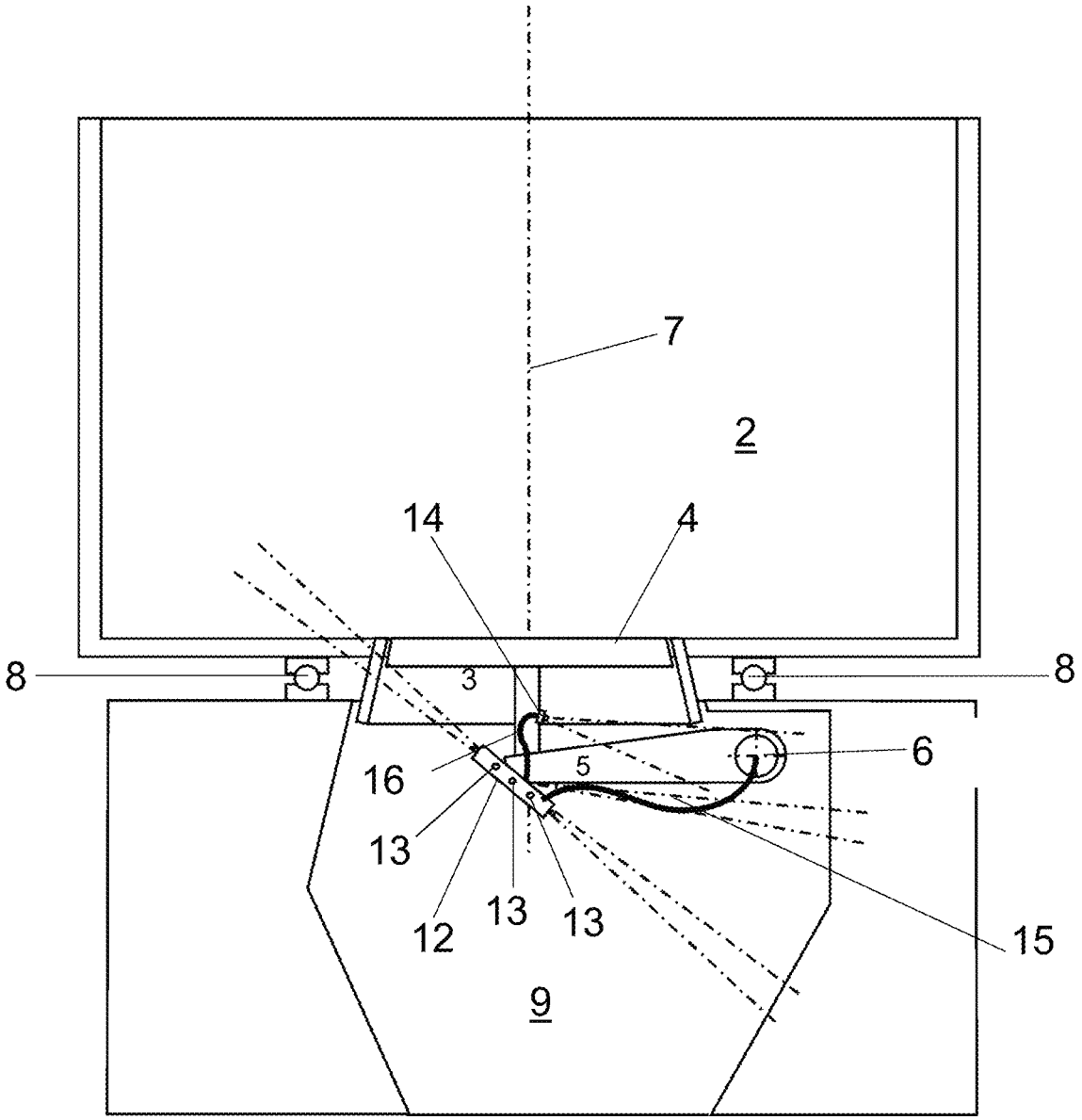
FIG. 2 shows a schematic representation of a first embodiment according to the invention with a closure cover in a closed position.

FIG. 2 shows a schematic representation of a first embodiment of the invention. Where possible, the same reference symbols were used for the same elements. In contrast to the embodiment of the prior art shown in FIG. 1, cleaning nozzles 13 are fastened to the closure cover 4 or to its swivel arm 5. For this purpose, the swivel arm 5 has a distributor 12 on which a plurality of cleaning nozzles 13 are arranged. In the embodiment shown, the distributor 12 has a circular cross section and has on its circumferential outer edge a plurality of openings sealed by cleaning nozzles 13. The liquid feed is supplied via the line 15, which extends through the swivel axis 6. The distributor 12 and thus all the cleaning nozzles 13 arranged thereon can be supplied with cleaning fluid via the line 15. The spray jets which can be generated by the cleaning nozzles 13 are indicated by way of example by the dot-dashed lines.

In the illustrated embodiment, a further cleaning nozzle 14 which is supplied with cleaning fluid via the line 16, which is connected to the distributor 12, is arranged such that it is directed at the swivel arm 5 or the swivel axis 6.

Figure 3:
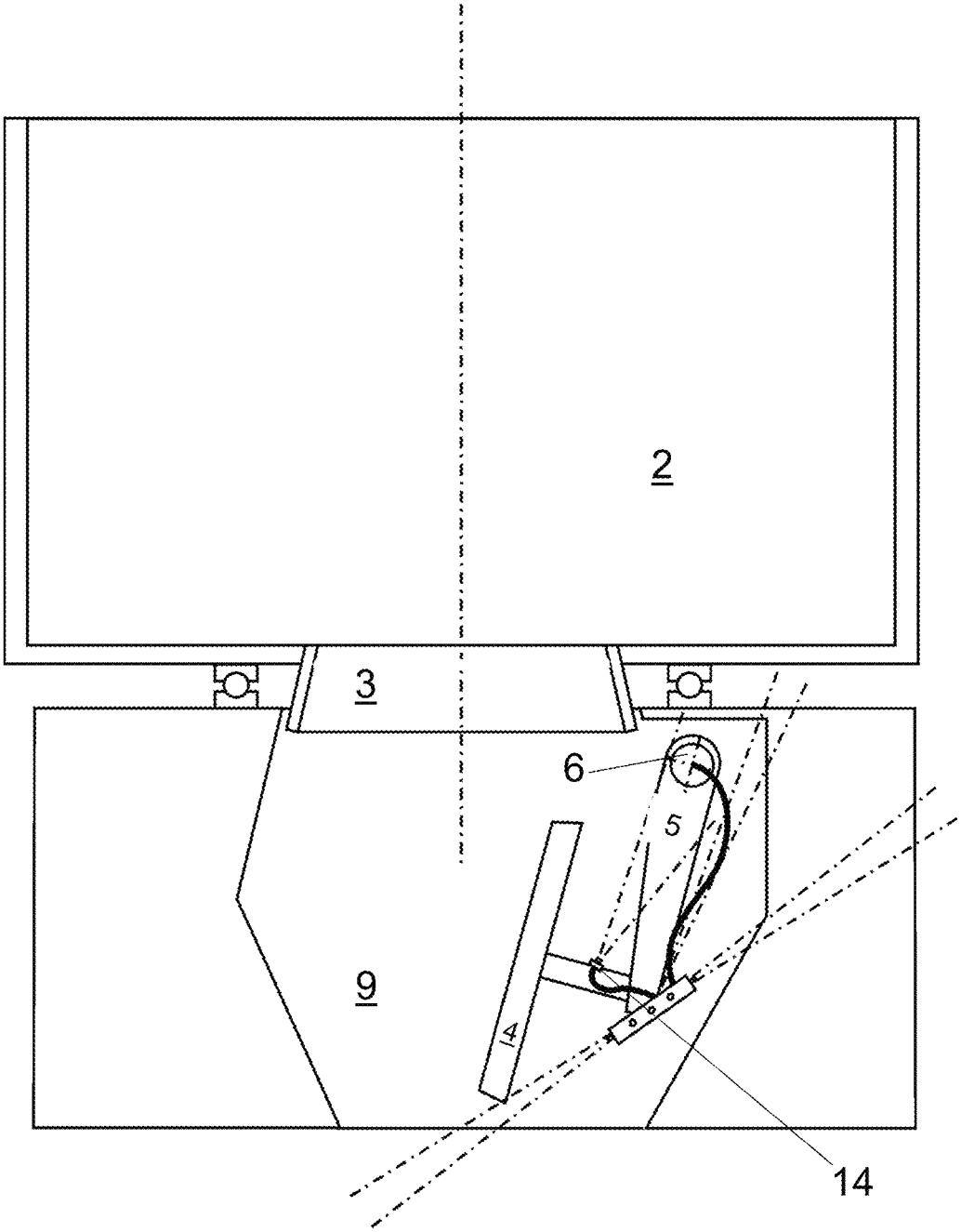
FIG. 3 shows a schematic representation of the embodiment from FIG. 2 with the closure cover in the open position and FIG. 4 shows a schematic representation of a second embodiment of the invention.

FIG. 2 shows the embodiment according to the invention with closed closure cover, i.e. the closure cover is in the closed position. In order to remove mixture from the mixing container 2, the closure cover 4 can be swivelled around the swivel axis 6 and moved back and forth between the closed position shown in FIG. 2 and the open position shown in FIG. 3. As a result of the back-and-forth movement, not only is the closure cover 4 moved from the closed position into the open position, in addition the cleaning nozzles arranged on the closure cover or on the swivel arm 5 are moved back and forth, as a result of which the spray jets indicated by the dot-dashed lines pass over and clean a large surface area of the mixture outflow region.

Figure 4:
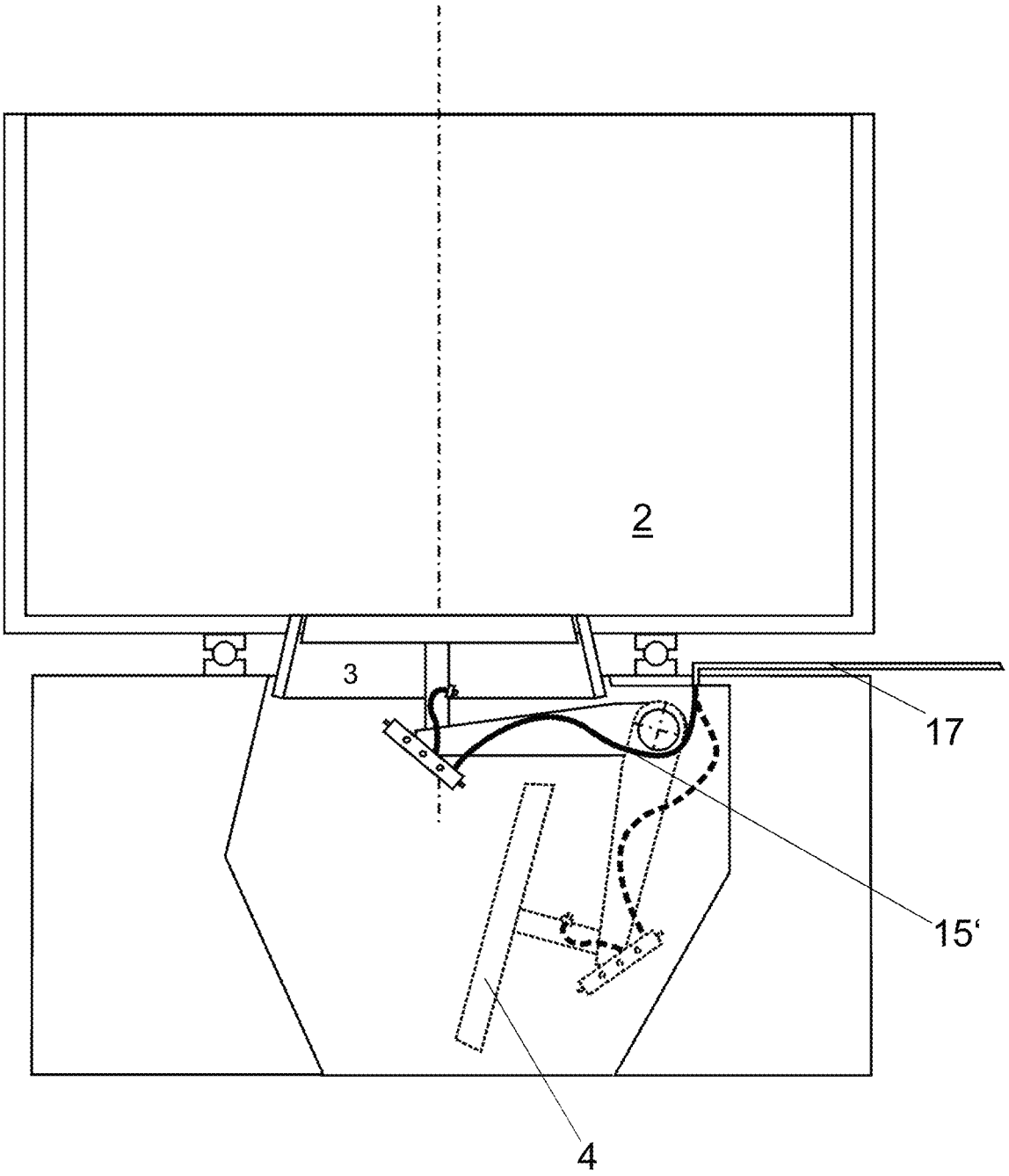

A second embodiment of the mixer according to the invention is illustrated in FIG. 4. This only differs from the embodiment shown in FIGS. 2 and 3 in showing an alternative liquid feed 15'. In the embodiment shown in FIG. 4 the liquid feed 15' no longer runs through the swivel axis 6, but is connected with the machine frame via a stationary line 17. This means that the line 15' must be of flexible design, since the swivel arm 5 moves relative to the stationary line 17. For example, the line 15' can be designed as a hose. It is advantageous in this embodiment that no rotary feedthrough, for example in the swivel axis of the swivel arm, is necessary in order to feed the cleaning fluid to the spray nozzles.

In all the embodiments shown, in order to achieve as complete as possible a cleaning of the outflow region, in addition to the nozzles 13 arranged in an annular manner on the distributor 12, further nozzles 14 are illustrated which clean the swivel arm itself or the space behind the axis of rotation of the swivel arm. One of the further nozzles is not visible in the figures, but its corresponding spray jet is also illustrated as a dot-dashed line. This nozzle is used to clean the wall behind the swivel axis 6 as far up as the upper corner of the mixture outflow region.

Naturally, as shown in the prior art, additional fixed nozzles can be arranged in the mixture outflow region 9, in the enclosing walls, in order for example to clean the outer edge and surface of the closure cover 4 or the sides of the swivel arms 5 during the swivelling movement.

Obviously, the nozzles do not necessarily need to be arranged in an annular manner, but can for example also be arranged distributed on a hemispherical distributor, in several rings, freely rotating or in any other form. Nor do the nozzles need to be connected with the swivel arm or the closure cover in a fixed position, but could also be fastened to a mounting which can in addition be moved kinematically around one or more spatial axes. The nozzles themselves can produce a constant spray pattern or also a rotating or pulsing spray pattern.

Fundamentally, each nozzle or a plurality of groups of nozzles could have separate liquid feeds and these could, via a control system, achieve a predetermined spray pattern through alternating opening and closing of the liquid feeds.

In order to clean the outflow region, the mixer is first completely emptied. It is not necessary and frequently also not desirable to feed cleaning fluid during the emptying process. Only after the mixer has been completely emptied and the mixture removed from the outflow region are the nozzles actuated in order to carry out the cleaning. During the cleaning cycle, the seal can be opened and closed several times or also only swivelled over partial regions with particularly heavy soiling. Since, as a rule, the mixture does not come into contact with and soil the outflow region evenly during the emptying process, in this way a targeted cleaning effect can be achieved.

LIST OF REFERENCE SYMBOLS

1 mixer
2 mixing container
3 outlet opening
3 closure cover
4 swivel arm
6 swivel axis
7 axis of rotation
8 bearings
9 mixture outflow region
10 cleaning nozzles
11 liquid feed
12 distributor
13 cleaning nozzles
14 cleaning nozzle
15, 15' liquid feed
16 line
17 stationary line

The invention claimed is:

1. A mixer comprising a mixing container having an outlet opening, a closure cover which can be moved back and forth between a closed position in which the closure cover closes the outlet opening and an open position in which the closure cover uncovers the outlet opening so that mixture can be removed from the mixing container via the outlet opening, at least one cleaning nozzle for cleaning the closure opening and/or a mixture outflow region arranged outside of the mixing container, and a liquid feed to feed cleaning fluid to the at least one cleaning nozzle, wherein the at least one cleaning nozzle is fastened to the closure cover, so that this can be moved together with the closure cover, wherein the closure cover has a swivel arm which is mounted rotatably around a swivel axis so that the closure cover can be swivelled around a swivel axis, wherein the liquid feed runs through the swivel axis.

2. The mixer according to claim 1, wherein the mixer has a mixture outflow region with an outflow wall which at least partially surrounds the outlet opening.

3. The mixer according to claim 1, wherein a plurality of cleaning nozzles is provided which are fastened to the closure cover, wherein the cleaning nozzles are configured such that in operation they produce a widening spray jet pattern.

4. The mixer according to claim 3, wherein the plurality of cleaning nozzles are arranged such that together they create a partially annular or annular sprayed area around the central point of the arrangement.

5. The mixer according to claim 3, wherein at least one cleaning nozzle is oriented in the direction of the swivel arm and/or the swivel axis.

6. The mixer according to claim 1, wherein the cleaning nozzle can be moved in a linear manner, swiveled or rotated relative to the closure cover.

* * * * *